United States Patent [19]

Russo

[11] 4,183,361

[45] Jan. 15, 1980

[54] RESPIRATORY EXERCISING DEVICE

[76] Inventor: Ronald D. Russo, 111 S. Barranca St., Apt. 327, West Covina, Calif. 91791

[21] Appl. No.: 881,672

[22] Filed: Feb. 27, 1978

[51] Int. Cl.[2] ..... A63B 23/00

[52] U.S. Cl. ..... 128/725; 272/99

[58] Field of Search ..... 128/2.08, 725, 726, 128/727, 728, 718, 719, 720; 272/99, DIG. 5; 73/209, 210, 207

[56] References Cited

U.S. PATENT DOCUMENTS

| | | | |
|---|---|---|---|
| 1,044,367 | 11/1912 | Evans | 272/99 |
| 2,099,842 | 11/1937 | Connell | 73/209 |
| 2,254,259 | 9/1941 | Aller | 73/209 |
| 2,827,008 | 3/1958 | Hodge | 73/207 |
| 3,416,371 | 12/1968 | Locke | 73/209 |
| 4,025,070 | 5/1977 | McGill | 272/99 |
| 4,060,074 | 11/1977 | Russo | 272/99 |
| 4,086,918 | 5/1978 | Russo | 272/99 |
| 4,114,608 | 9/1978 | Russo | 272/99 |
| 4,138,105 | 2/1979 | Hunger | 272/99 |

*Primary Examiner*—Richard J. Johnson
*Attorney, Agent, or Firm*—Bruce & McCoy

[57] ABSTRACT

A respiratory exercising device including an upright structure having a continuous precalibrated air flow column, air inhalation means in pneumatic communication with the air flow column and an air flotation element which may be moved within the air flow column to measure inhalation rates.

6 Claims, 10 Drawing Figures

RESPIRATORY EXERCISING DEVICE

CROSS-REFERENCES TO RELATED APPLICATIONS

An application filed concurrently herewith by the same inventor for an invention which is in the field of this device.

BACKGROUND OF THE INVENTION

1. FIELD OF THE INVENTION

The present invention relates to the field of exercising devices and more particularly to an exercising device for measuring human breath inhalation rates and promoting proper breathing especially for persons who have breathing problems.

2. DESCRIPTION OF THE PRIOR ART

There has been a need in the medical field for devices which can measure the ability of patients to inhale, as well as to provide incentives for patients to fully develop or rebuild their respiratory systems. These patients may include post surgical, inactive, obese, and geriatric patients who need to increase their lung capacity. To encourage these patients to overcome their pain or discomfort in breathing deeply, an incentive measuring device which encourages a proper type of breathing is needed.

It is believed that the most beneficial results of breathing occur when there is a slow, sustained and deep inhalation of air into the lungs. It is with that kind of inspiration that there is the maximum expansion of the lungs and the optimal conditions for gaseous exchange at the aveolar sites, or air cells, of the lungs. A sustained, steady, deep inhalation of laminar flow is preferred for patients rather than a short, rapid, non-gradual inhalation effort which causes turbulent flow.

The device disclosed in U.S. Pat. No. 4,060,074 issued Nov. 29, 1977, is intended to provide some of the features required for achieving the desired results. The principal device described in that patent has three adjacent chambers, each containing a ball, and an air passageway common to all three chambers. In operation when a person inhales through the device, air flows through all chambers and the air passageway and if a minimum flow rate is exceeded the balls will be raised sequentially to the tops of the chambers.

One of the problems with the prior art device is that a ball is not actuated at all until there is a minimum flow of air through the whole device. However, it has been found in this device that the lowest accurate measurable flow rate when used in its normal position is approximately 600 cc/sec, which is greater than most respiratory patients can accomplish at the beginning of their therapy and greater than the optimal therapeutic rates for these patients. Thus there is a need for an incentive inhalation device which can accurately measure the preferred laminar inhalation rates and can provide patients with a visible readout of their efforts in that range of air flow.

A further problem with the prior art device is that although air is drawn into the whole device, the air flow may become restricted during its operation. The air passageway which is common to all the chambers of the device and through which air is withdrawn from the entire system is considerably smaller in cross-sectional area than the chambers and may cause an impedance to the air flow. Additionally, when the precalibrated flow rate has been achieved, each of the balls rises sequentially in its chamber and closes off the air exit at the top. This causes a sudden restriction in the air flow through each chamber as it is closed off, which interrupts the inhalation effort of the user attempting to achieve a smooth air flow. A further negative effect of this feature of operation is that as subsequent balls are raised, a patient is forced to expend unnecessary energy to keep the previously raised balls suspended.

By virtue of the construction of this multi-chambered device, and the fact that the air flow is being drawn through each chamber concurrently until the first chambers are closed, it is expected that the process of calibration is quite difficult, especially at the low laminar flow rates.

A further disadvantage of the prior art device of U.S. Pat. No. 4,060,074 is that it does not provide any indication of inhalation rate until the first ball is raised. At that point a user can see only that he or she has exceeded the specified rate and cannot be certain of the exact inhalation rate of air flow achieved. Then only a very limited number and range of rates can be measured. Thus there is a need for an inhalation device that can provide a simple but accurate readout of small variations in air flow, especially at the preferred low inhalation laminar flow rates. There is also a need for an inhalation meter for healthier patients which can accurately measure a wider range of inspiration rates and which has very little air flow restriction throughout its system. The present invention provides a solution to these problems and overcomes the disadvantages of the prior art devices by providing an inhalation measurement device with a simple readout and sensitivity over a wide range of inhalation rates but with minimum restriction on the air flow to the user.

SUMMARY OF THE INVENTION

The present invention is an improved respiratory exercising device having a structure which provides a continuous generally vertical air flow column. The column has a cross-sectional dimension which increases in size in graduated increments over its length and which is larger at the top than at the bottom. Air inhalation means are in pneumatic communication with the air flow column so that a person may inhale through the air inhalation means and draw air through the column from its bottom to its top. An air flotation element is movably disposed in the air flow column and formed to be raised within the column by inhalation through the device by an operator. The air flotation element is sized to fit relatively closely within the air flow column. Due to the increase in cross-sectional dimension of the column over the column's length, a given inhalation effort will cause the air flotation element to stabilize at a position in the air flow column relative to the flow rate of air being drawn through the device. The air flow column is precalibrated so that different air flow rates are indicated at each change in cross-sectional dimension.

OBJECTS OF THE INVENTION

It is therefore an important object of the present invention to provide a respiratory exercising device which has sensitivity at low inhalation rates but yet accurately measures a wide range of inhalation rates.

It is another object of the present invention to provide a device which has a simple readout of inhalation rates.

It is a further object of the present invention to provide a device which has a minimum of restriction to the air flow and permits efficient and uninterrupted air flow during operation by the user.

It is yet another object of the present invention to provide a device which is easy to use by patients and which provides incentives for respiratory exercise.

It is yet a further object of the present invention to provide a device which may be inexpensively manufactured and which has features adaptable to several desirable accessory items.

It is still another object of the present invention to provide a device which permits a full free uninterrupted flow of air during exercise and which suspends the flow rate indicator in a free float state at predetermined flow rate positions long enough to record a measurement of the flow.

Other objects and advantages of the invention will become apparent when it is considered in conjunction with the accompanying drawings.

DESCRIPTION OF THE PREFERRED EMBODIMENT

Figure 1:
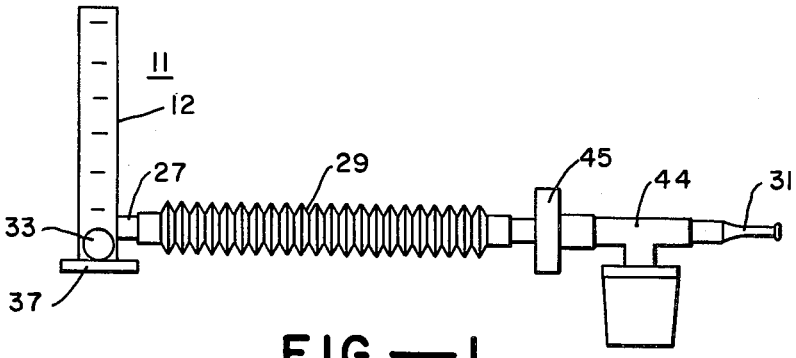
FIG. 1 is a side elevational view of the improved respiratory exercising device of the present invention shown with various accessories which may be connected to it.
Figure 2:
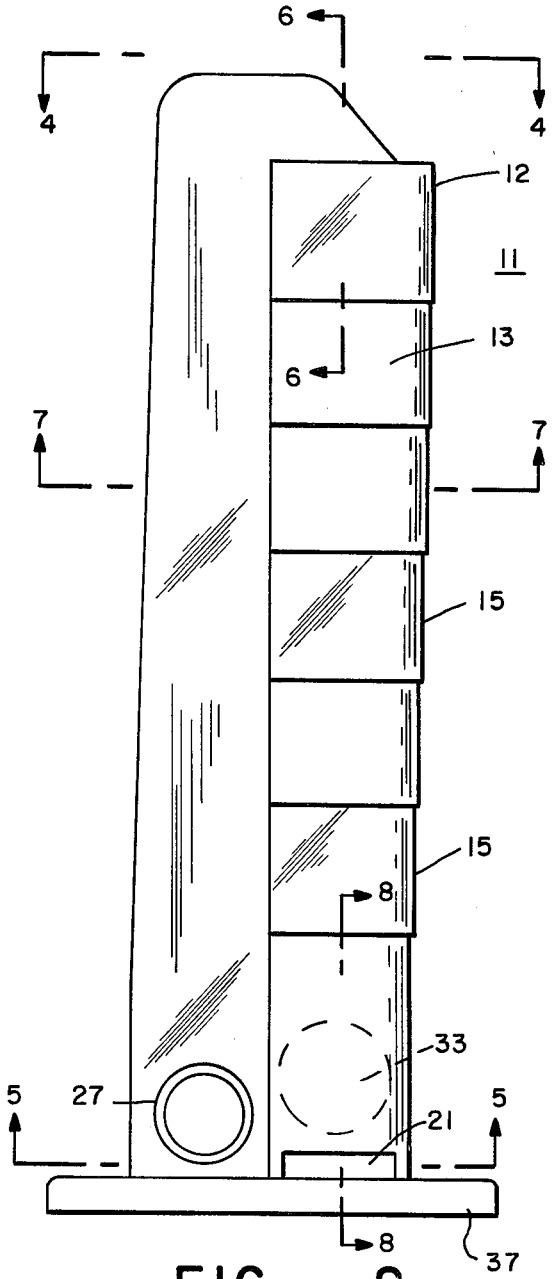
FIG. 2 is a front elevational view of one of the embodiments of the present invention.
Figure 4:
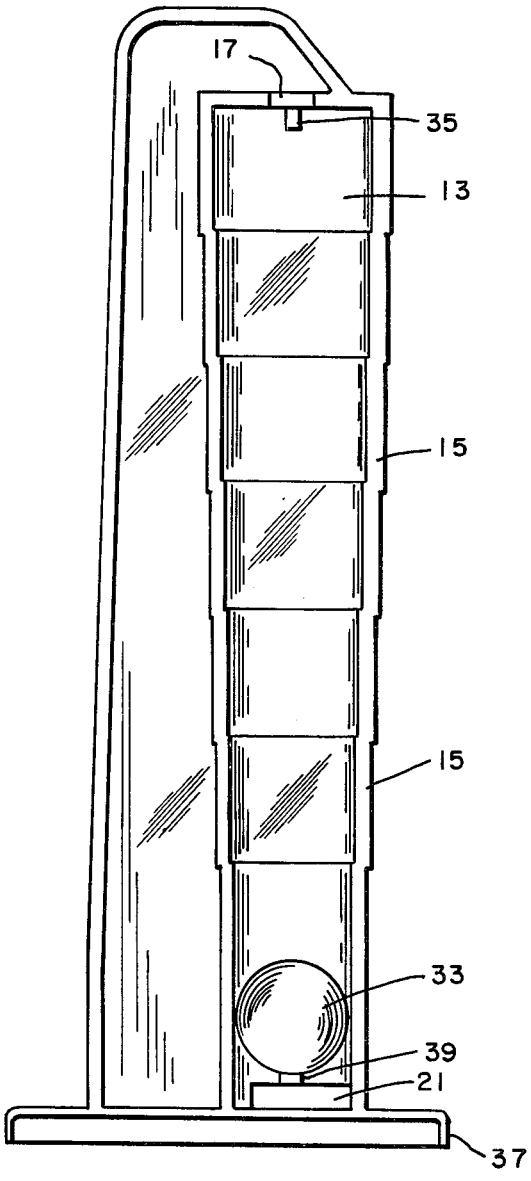
FIG. 4 is a front elevational view of one-half of the present invention taken along lines 4—4 of FIG. 3 which is a natural separation line of the injected molded portions of the preferred embodiment.

The present invention is an improved respiratory exercising device 11 which has a structure 12 having a continuous vertical air flow column 13 therein. The column has a top end and a bottom end and a cross-sectional dimension which increases in graduated increments over the length of the air flow column, being smaller at the bottom end than at the top end. The air flow column in the preferred embodiment is formed from a plurality of segments 15 of different cross-sectional dimensions. Each segment has a constant cross-section along its length. The segments are sequentially disposed in the air flow column in the order of increasing cross-sectional dimension from the bottom to the top of the air flow column. In the preferred embodiment the segments of the column are cylindrical, vertically aligned, integrally connected, and generally transparent. The term cross-sectional dimension as used herein may refer to any factor used in measuring the cross-sectional area of a segment of the column. Generally in the preferred embodiment where the column segments are cylindrical the term cross-sectional dimension refers to the inner diameter of each segment. Where the column segments are other than circular in cross-section (e.g., square or elliptical) the term may refer to length, width, radius or some other appropriate unit of measurement. This continuous air flow column is precalibrated for different air flow rates as will be seen hereafter.

The air flow column 13 has an air outlet 17 at its top end and the cross-sectional dimension of this air outlet is between $\frac{1}{8}$th and $\frac{3}{4}$th the cross-sectional dimension of the air flow column at its top end. It has been found that the inner diameter of this top opening should be at least $\frac{1}{4}$ inch (0.64 cm) to permit a sufficient flow of air through the air flow column, and when a full range of inhalation rates is desired it is generally not greater than $\frac{5}{8}$ inch (1.59 cm) where the inner diameter of the column is less than two inches (5.08 cm). The size of this air outlet 17 is believed to be important in achieving the optimal results of this invention. If its diameter is too small relative to the diameter of the column segments, the air flow is restricted within the device causing the patient unnecessary effort. If the diameter is too large then the sensitivity of the device in the higher ranges of inhalation rates cannot be achieved. In the preferred embodiment, the optimal inner diameter is approximately $\frac{3}{8}$ inch (0.95 cm).

The upright structure 12 has at least one air intake slot 21 proximate the lower-most portion of the air flow column 13 so that air can be drawn through the air intake slot into the air flow column 13 and out the air outlet 17 of the column with a minimum of restriction of the air flow. The actual size of this air intake slot is not critical to the operation of the device so long as it allows a full intake of air. In the preferred embodiment there are two air intake slots, each approximately 7/32 inches (0.56 cm) high and equal in length to arcs of approximately 120 degrees.

The present invention also includes an air inhalation means which is in pneumatic communication with the air flow column 13 so that a person inhaling through the air inhalation means will draw air through the air flow column from its bottom end towards its top end. The air inhalation means in the preferred embodiment includes an air duct 23 adjacent to the air flow column with the top portion 25 of the air duct in pneumatic communication with the top end of the air flow column. The air duct also has a bottom outlet 27 whereby there may be a continuous flow of air from the air flow column through the air duct and air may be withdrawn from the air duct through its bottom outlet. In the preferred embodiment the air duct 23 is integrally attached to the air flow column and a substantial portion of the air duct is disposed upright and parallel to it. A top portion 25 of the air duct laps over and completely encloses the air outlet 17 of the air flow column. The bottom outlet 27 of the air duct allows air to be withdrawn from the duct and from the column and may include a tubular projection 27 to facilitate the attachment of an air withdrawal means to it. The exact configuration and dimensions of the air duct are not critical to the operation of this invention, so long as the air duct has a minimum cross-sectional area to allow a full unrestricted flow of air. In the preferred embodiment the dimensions taken at the point of smallest cross-sectional area are approximately ⅝ inches by ¾ inches (1.59 cm by 1.91 cm). Of course, it is recognized that tubing or the like could be attached to the top of the column to permit inhalation through the air flow column, so long as the air outlet at its top were enclosed. However, the air duct described in the preferred embodiment of the invention allows the entire structure to be more stable and easily maintained in an upright position during normal use.

Air withdrawal means are attached to the bottom outlet 27 of the air duct 23 to withdraw air from the device. In the preferred embodiment, the air withdrawal means includes hollow tubing 29, which is attached at one end to the bottom outlet of the air duct and which has a mouthpiece 31 attached to the other end. This flexible hollow tubing which may be made of standard polyethylene or EVA tubing, enables one to use the device even at some distance from the upright structure.

In the preferred embodiment, the air duct 23 further comprises air filtering means (not shown) to prevent extraneous matter from being inhaled through the device into the lungs of the patient. An air filtering means typically used is an injection-molded air flow screen which is disposed in the air duct near the bottom opening 27 thereof.

An air flotation element 33 or flow indicator is movably disposed in the air flow column 13 whereby it may be raised within the column by inhalation through the air inhalation means. The air flotation element is sized to fit relatively closely within the air flow column and due to the increase in the air flow column's cross-sectional dimension at different locations in the column, a given inhalation effort between maximum and minimum efforts will cause the air flotation element to stabilize at a position proximate one of the diameter changes between the top and bottom of the air flow column. A suitable change in inhalation effort will cause a measurable change in the position of the air flotation element 33 within the column 13.

The air flotation element 33 may be any lightweight article but a sphere is preferred when the air flow column 13 is cylindrical. In the preferred embodiment a hollow lightweight sphere formed by blow-molding polyethylene plastic is used. In the examples set forth hereinafter where the inner diameters of the column segments are between 1.04 inches (2.64 cm) and 1.40 inches (3.56 cm) the outer diameter of the hollow sphere is approximately 1 inch (2.54 cm) with a tolerance of 1.005 inches to 1.02 inches (2.553 cm to 2.591 cm). The hollow sphere weighs approximately 1.5 grams (tolerance 1.35 g to 1.75 g). Thus it is seen that the preferred air flotation element is a lightweight sphere with an outer diameter which is slightly less than the inner diameter of the smallest column segment.

The air flow column 13 is precalibrated to different inhalation rates in accordance with changes in the inner diameters of the column segments 15 and is marked by air flow calibrations disposed on the structure. It has been found that the rate of air flow required to raise the small lightweight sphere in the column described herein increases when the inner diameter of the column increases. It is believed that this effect is correlated with changes in the size of the gap between the lightweight space and the walls of the column segments so that as more air can pass around the sphere a greater inhalation effort is needed to raise it. It has been found that this gap must be large enough to prevent restriction to the air flow, but it must be small enough to allow sensitivity in the measurement of inhalation rates as low as 150 cc/sec.

Figure 3:
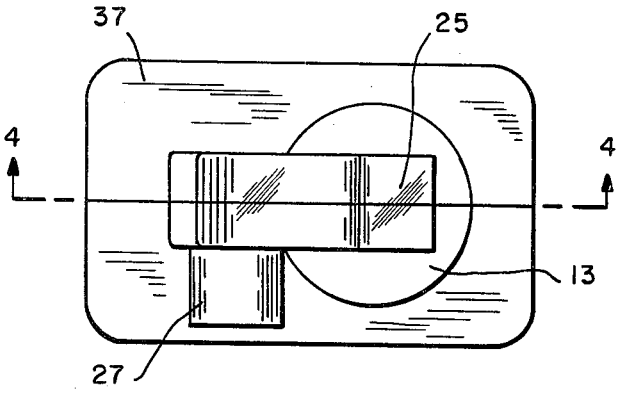
FIG. 3 is a top plan view of the embodiment of the present invention shown in FIG. 2.
Figure 5:
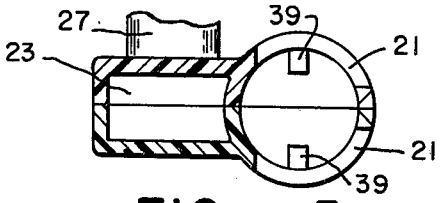
FIG. 5 is a cross-sectional view of the present invention taken along lines 5—5 of FIG. 2.
Figure 6:
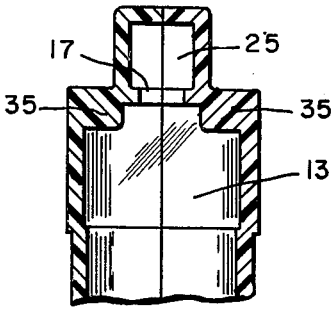
FIG. 6 is a partial sectional view of the present invention taken along lines 6—6 of FIG. 2 showing the junction of the air duct with the air flow column.
Figure 7:
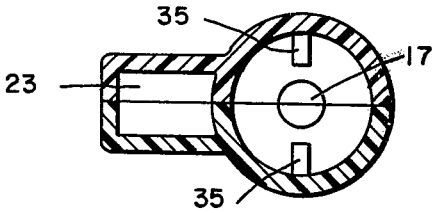
FIG. 7 is a cross-sectional view of the present invention taken along lines 7—7 of FIG. 2 illustrating the air outlet of the air flow column and the means to prevent closing thereof.
Figure 8:
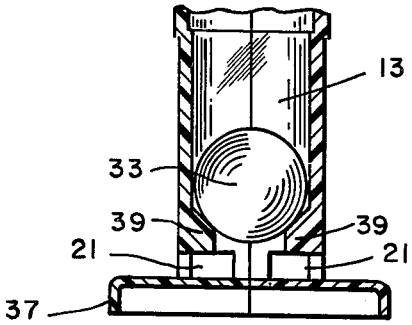
FIG. 8 is a partial cross-sectional view of the present invention taken along lines 8—8 of the air flow column shown in FIG. 2.
Figure 9:
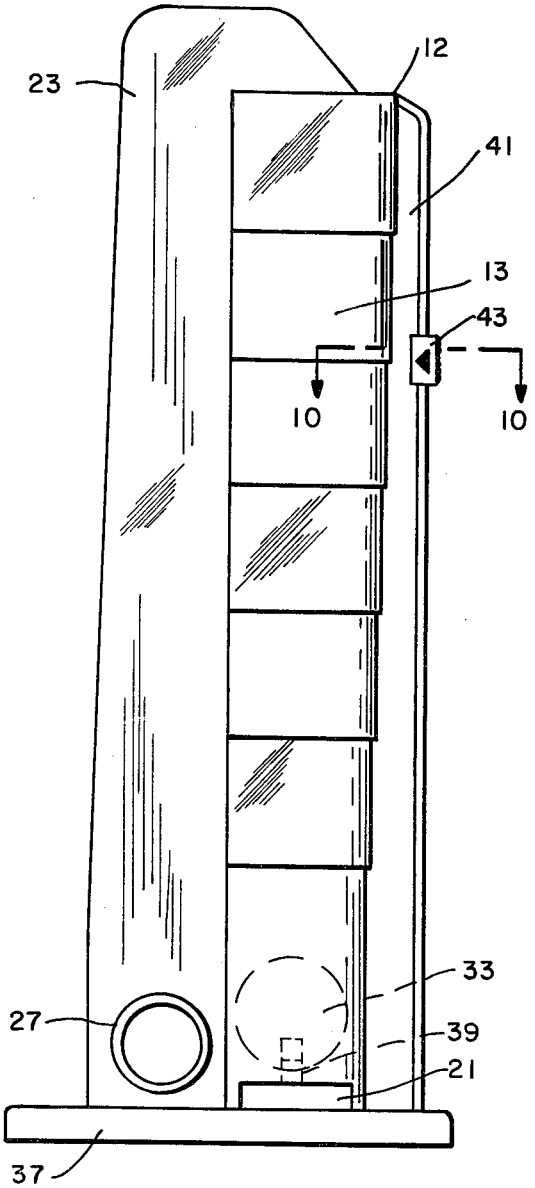
FIG. 9 is a front elevational view of another embodiment of the present invention illustrating the incentive inhalation marker.
Figure 10:
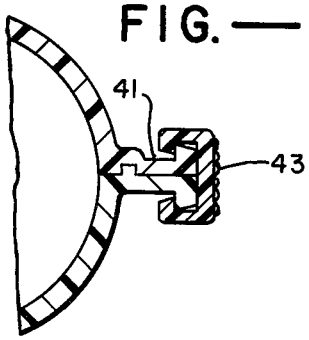
FIG. 10 is a partial cross-sectional view of the present invention taken along line 10—10 of FIG. 9.

This device may be easily manufactured. Portions of the upright structure 12 may be formed by the injection molding of any clear high impact plastic material. Ideally, front and rear portions of the upright structure having a tongue and groove orientation may be individually formed by injection molding. The blow-molded lightweight sphere is placed in one portion of the column and then the front and rear portions may be assembled in line with the tongues and grooves and then ultrasonically welded together. FIGS. 3 and 5–8 more particularly illustrate the preferred junction of the front and rear portions.

The upright structure 12 further includes means to prevent the air flotation element 33 from closing off the air outlet 17 when it is raised to the top of the air flow column 13. Generally, this can be effected by one or more projections 35 disposed proximate the top of the air flow column such that the air flotation element is prevented from reaching the very top of the column whereby the air flow remains unrestricted through the column at all times.

In the preferred embodiment, the upright structure 12 and the air duct 23 are mounted upon and are supported by a perpendicular base member 37 which maintains the device in a vertical position when it is used by a patient.

A means is provided on the upright structure proximate the bottom of the air flow column to support the hollow lightweight ball above the air intake slot. This may be a projection from the base 37 of the device or one or more projections 39 from the sides of the air flow column. The preferred configuration and location of such supporting projections are particularly illustrated in FIG. 8.

In another embodiment of this invention a flange 41 may be longitudinally mounted on the upright structure 12 so that it will support a slidable incentive level marker 43. This marker may be moved along a vertical axis of the flange to indicate a certain inhalation rate, for example, by the patient to mark the highest inhalation rate achieved, or by the doctor, to encourage a desirable rate of inspiration.

The device of this invention 11 may be adaptable to the needs of individual patients by the attachment of several accessories. A medicinal dispensing device 44 can be connected to the pneumatic system either near the bottom opening of the air duct 27 or between the tubing 29 and its mouthpiece 31. A dual valve 45 of uniform fitting may also be inserted into the pneumatic system between the flexible tubing and the mouthpiece of the tubing, on either side of the medicinal dispensing device. By the addition of these accessories a physician may prescribe a particular medication or vapor which is placed in a standard nebulizer 44 or in a nebulizer adapted for this system and then attached to the flexible tubing or to a dual valve 45. A dual valve attached to the tubing makes it possible for a person to inhale air or medication at a measurable rate through the system with the mouthpiece in place. Without removing the mouthpiece from the person's mouth he or she can exhale and direct the exhaled air into the atmosphere or the nebulizer rather than back into the inhalation device. This configuration of accessories would be particularly helpful to a bedridden or weak patient.

Thus, a person may inhale through the tubing 29 and cause air to be drawn into this device 11 through the air intake slot 21 at the bottom end of the air flow column 13, through the air flow column 13, out its air outlet 17 into the air duct 23, through the duct and then withdraw air from the bottom outlet 27 of the air duct through the tubing and any accessories attached thereto into the person's lungs. The air drawn into the air flow column will cause the air flotation element 33 to be raised to some position within the column and to be suspended in a free float state at that position. By making a visual comparison of the location of the air flotation element with the calibrations disposed on the structure (not shown), one can easily determine the inhalation rate of air flow through the system.

In the preferred embodiment the column 13 can be calibrated to measure flow rates between 150 cc/sec and 2000 cc/sec, which covers the full expected range of inhalation rates. For a first example, with segments of the air flow column having the following inner diameters, one may mark the column accordingly and measure the following corresponding inhalation rates by noting the position within the column at which the air flotation element 33 is suspended:

| Inner Diameter (Inches/cm) | Inhalation Rate (cc/sec) |
|---|---|
| 1.400/3.556 | 2000 |
| 1.300/3.302 | 1700 |
| 1.220/3.099 | 1400 |
| 1.155/2.934 | 1100 |
| 1.120/2.845 | 800 |
| 1.080/2.743 | 500 |
| 1.040/2.642 | 150 |

In this example, the inner diameter of the air outlet 17 of the column is approximately ⅜ inches (0.95 cm), the heights of all the segments except the lowest and highest are approximately 1⅛ inches (2.86 cm) each, and the outer diameter of the air flotation element 33 is approximately 1 inch (2.54 cm). In this embodiment, the two lowest levels of 150 and 500 cc/sec measure laminar air flow; the 800 and 1100 cc/sec levels measure intermediate air flow; and the upper three levels measure turbulent flow.

It may be desirable to expand the sensitivity of the lower range for patients whose progress is more critical in the laminar range. For a second example, the following dimensions could be used:

| Inner Diameter (Inches/cm) | Inhalation Rate (cc/sec) |
|---|---|
| 1.190/3.023 | 1300 |
| 1.160/2.946 | 1100 |
| 1.130/2.870 | 800 |
| 1.100/2.794 | 600 |
| 1.070/2.718 | 400 |
| 1.040/2.642 | 150 |

The inner diameter of the top opening is again ⅜ inch (0.95 cm). The outer diameter of the air flotation element is approximately 1 inch (2.54 cm) and the heights of the segments vary from 1¼ inch to 1¾ inch (3.18 cm to 4.45 cm).

In the above examples the dimensions have been determined by trial and error and there has not yet been devised a critical formula for other embodiments or examples of this invention.

It is seen, however, that other embodiments of this invention with different ranges of inhalation rates are thus possible by varying the size and number of the individual segments 15 of the air flow column 13. It should also be appreciated that the calibration of the flow rates per diameter in actual practice of the invention can be made more exact than the examples provided herein.

This invention thus provides a device which is designed to be easily assembled and easily used without supervision after minimum instruction. This device allows sensitive measurement of preferred inhalation rates for weak patients without any abrupt changes in air flow. It has a design with an easy and attractive readout that gives those patients the incentive to follow a prescribed exercise program. The device may be designed and calibrated to measure either a wide range of inhalation rates (from 150–2000 cc/sec) or a more sensitive scale within that range (e.g., 150–1000 cc/sec).

A further advantage of this invention over the prior art is that with this device the air flotation element can be "locked in" or stabilized at a particular rate of air flow, allowing the operator to fully observe his or her inhalation rate before its position changes. This feature is a result of the incremental changes in inner diameters of the segments. A tapered conical column having a larger inner diameter at its top end than at its bottom but without graduated differences through the column, could be used in this invention, but it is believed that it would be more difficult to suspend the air flotation device at any particular level in such a device. In the present invention one can easily observe that the operator has exceeded a particular inhalation rate and one can determine accurately what rate was achieved, in contrast to the prior art where one can only determine whether one has inhaled at a certain rate and not any intermediate rates over that. Thus it is seen that the present invention provides a versatile, accurate and sensitive device for measuring inhalation rates and providing incentives to patients to accomplish respiratory exercise.

Various other modifications, alternatives and equivalents may be employed without departing from the true spirit and scope of the invention, except insofar as the invention may be limited by the following claims.

What I claim is:

1. An improved self-supporting respiratory exercising device comprising a structure having a continuous generally vertically disposed air flow column formed therein, said column having a cross-sectional dimension which increases in size in graduated increments over the length of said air flow column and being larger at its top end than at its bottom end, said air flow column including an air outlet at its top end, with a cross-sectional dimension between ⅛th and ¾ths the cross-sectional dimension of the top end of the air flow column, and an air intake slot at the bottom end thereof whereby air can be drawn upwards through said column, an air duct formed in said structure adjacent said air flow column with a bottom outlet and the upper end of said duct arranged in pneumatic communication with the top end of the air flow column, means attached to the bottom outlet of the air duct for withdrawal of air therefrom through said column, an air flotation element movably disposed in said air flow column and formed to be raised within said column by inhalation of air through said device by an operator, said air flotation element being sized to fit relatively closely within said air flow column wherein, due to the increase in the air flow column's cross-sectional dimension at intervals over the column's length, a given inhalation effort between minimum and maximum efforts will cause said air flotation element to stabilize at a position between the top and bottom of said air flow column relative to the flow rate of air being drawn upwards through said air flow column, air flow calibrations disposed on said structure to indicate different air flow rate for each change in cross-sectional dimension when the air flotation element stabilizes at a precalibrated level in the column when air is being drawn through the device, means for preventing said air flotation element from closing off the air at the top of the air flow column, and means formed in said structure at the bottom of the air flow column for supporting said air flotation element above said air intake slot and permitting air to flow around said air flotation element.

2. The improved respiratory exercising device of claim 1 wherein the air flotation element comprises a hollow blow-molded lightweight sphere and wherein the upright structure is formed from a clear plastic material from as few as two pieces individually formed by injection molding and ultrasonically welded together into an integral unit with the hollow lightweight sphere enclosed therein.

3. An improved respiratory exercising device comprising an upright structure having a continuous vertical air flow column formed from a plurality of integrally connected transparent cylindrical segments, each of said segments having a different inner diameter which is constant over its length, said segments being sequentially disposed in order of increasing inner diameter from the bottom of the air flow column to its top, a lightweight sphere movably disposed internally of said air flow column and sized to fit relatively closely within the diameter of the smallest segment, an air intake slot disposed proximate the lower end of the air flow column and an air outlet disposed at the top of the air flow column with the inner diameter of said air outlet being between $\frac{1}{8}$th inch (0.32 cm) and $\frac{1}{2}$ inch (1.27 cm), at least one projection disposed proximate the top of the air flow column such that said lightweight sphere is prevented from closing off the air outlet, an air duct formed integral to said upright structure and in pneumatic communication with the air outlet of said air flow column, said air duct having a bottom outlet whereby air may be withdrawn from said air flow column through said air duct, means attached to the bottom outlet of said air duct for permitting inhaling of air therethrough and thereby causing the lightweight sphere to be raised to a position between the top and the bottom of the air flow column, air flow calibrations disposed on said upright structure to indicate a plurality of different air flow inhalation rates, said calibrations being relative to the inner diameters of the segments whereby when the lightweight sphere is stabilized at a level in said column when air is being inhaled through the device, a precalibrated inhalation flow rate is indicated, means formed in said upright structure proximate the bottom of said air flow column for supporting said lightweight sphere above said air intake slot and permitting air to flow around said air flotation element, and a generally perpendicular base member supporting said structure.

4. The improved respiratory exercising device of claim 3 wherein the air flow column when disposed in an upright position is calibrated to accurately measure a plurality of inhalation air flow rates which may range between 150 and 2000 cc/sec when the air outlet of said column has a diameter of $\frac{3}{8}$ inch (0.95 cm).

5. The improved respiratory exercising device of claim 3 wherein a flange is longitudinally mounted on the upright structure and is formed so that a slidable incentive level marker may be supported on said flange for indicating a preselected inhalation rate.

6. The improved respiratory exercising device of claim 4 wherein the outer diameter of the lightweight sphere is approximately 1.0 inches (2.54 cm), the inner diameter of the lowermost segment is approximately 1.04 inch (2.64 cm) and the inner diameter of each additional segment increases by at least 0.03 inch (0.076 cm) per segment.

* * * * *